US009592435B1

(12) United States Patent
Faucette

(10) Patent No.: US 9,592,435 B1
(45) Date of Patent: Mar. 14, 2017

(54) ATTACHABLE GOLFING AID

(71) Applicant: Tiffany Faucette LLC, Ashburn, VA (US)

(72) Inventor: Tiffany Faucette, Ashburn, VA (US)

(73) Assignee: FIGHTING GOLF LLC, Ashburn, VA (US)

( * ) Notice: Subject to any disclaimer, the term of this patent is extended or adjusted under 35 U.S.C. 154(b) by 0 days.

(21) Appl. No.: 14/957,354

(22) Filed: Dec. 2, 2015

(51) Int. Cl.
*A63B 69/36* (2006.01)

(52) U.S. Cl.
CPC .. *A63B 69/3608* (2013.01); *A63B 2208/0204* (2013.01)

(58) Field of Classification Search
USPC ..... 473/205, 207, 208, 211, 212, 215, 257, 473/276
See application file for complete search history.

(56) References Cited

U.S. PATENT DOCUMENTS 3,643,960 A * 2/1972 Gentilly ..... A63B 69/3608 446/193
5,658,203 A * 8/1997 Shub ..... A63B 69/0059 473/205
5,890,968 A * 4/1999 Mingo ..... A63B 69/0059 434/252
6,994,633 B2 2/2006 Czaja et al.
7,214,139 B2 5/2007 Parris et al.
7,431,661 B1 10/2008 Cailey
7,874,941 B1 * 1/2011 Boytos ..... A63B 69/3608 473/207
8,043,163 B2 10/2011 Proplesch
8,696,482 B1 4/2014 Pedenko et al.
2002/0039930 A1 * 4/2002 Smith ..... A63B 69/0059 473/215
2009/0258719 A1 10/2009 Wortman

* cited by examiner

*Primary Examiner* — Nini Legesse
(74) *Attorney, Agent, or Firm* — Buchanan Ingersoll & Rooney PC

(57) ABSTRACT

An attachable golfing aid is operable to provide a reference for a golfer during a swing. The attachable golfing aid includes an attachable component that is attachable to a body of the golfer or a shirt of the golfer. The attachable golfing aid also includes an outwardly extending visual aid that extends outwardly from the shoulder of the golfer when the attachable component is attached to the body of the golfer or the shirt of the golfer wherein the outwardly extending visual aid is configured to indicate an alignment and/or position of the golfer's shoulder before, during, and/or after a swing of the golfer.

19 Claims, 6 Drawing Sheets

ATTACHABLE GOLFING AID

FIELD OF THE INVENTION

This invention pertains to golf aids, and may find particular use in golf aids that are attachable to a body of a golfer or a shirt of a golfer.

BACKGROUND

Golf is a complex sport that involves a summation of human movement and forces prior to, during, and after ball contact. Golf aids can help a golfer improve their game. Some devices vary tremendously, while others have only minor variations that separate them; therefore, even subtle differences can make a large difference in a complex series of alignments and movements involved in every golf stroke. Further, many golfing aids must be placed on the ground and moved from position to position to practice different shots. Thus, there is a need for an attachable golfing aid that aids in the alignment of a golfer's shoulders during a golf stroke.

SUMMARY

Disclosed herein is an attachable golfing aid operable to provide a reference for a golfer during a swing. The attachable golfing aid includes an attachable component that is attachable to a body of the golfer or a shirt of the golfer. The attachable golfing aid also includes an outwardly extending visual aid that extends outwardly from the shoulder of the golfer when the attachable component is attached to the body of the golfer or the shirt of the golfer. The outwardly extending visual aid is configured to indicate an alignment and/or position of the golfer's shoulder before, during, and/or after a swing of the golfer.

Also disclosed herein is attachable golfing aid operable to provide a reference for a golfer during a swing. The attachable golfing aid includes an attachable component that is attachable to a body of the golfer or a shirt of the golfer. The attachable golfing aid includes an upwardly extending visual aid that extends upwardly from the shoulder of the golfer when the attachable component is attached to the body of the golfer or the shirt of the golfer. The upwardly extending visual aid is configured to indicate an alignment and/or position of the golfer's shoulder before, during, and/or after a swing of the golfer.

Further disclosed herein is an attachable golfing aid operable to provide a reference for a golfer during a swing. The attachable golfing aid includes a contoured plate that is attachable to a body of the golfer or a shirt of the golfer. The contoured plate includes a first connection element configured to connect to an optional removable outwardly extending visual aid and a second connection element configured to connect to an optional removable upwardly extending visual aid.

BRIEF DESCRIPTION OF THE DRAWING FIGURES

DETAILED DESCRIPTION

Figure 1:
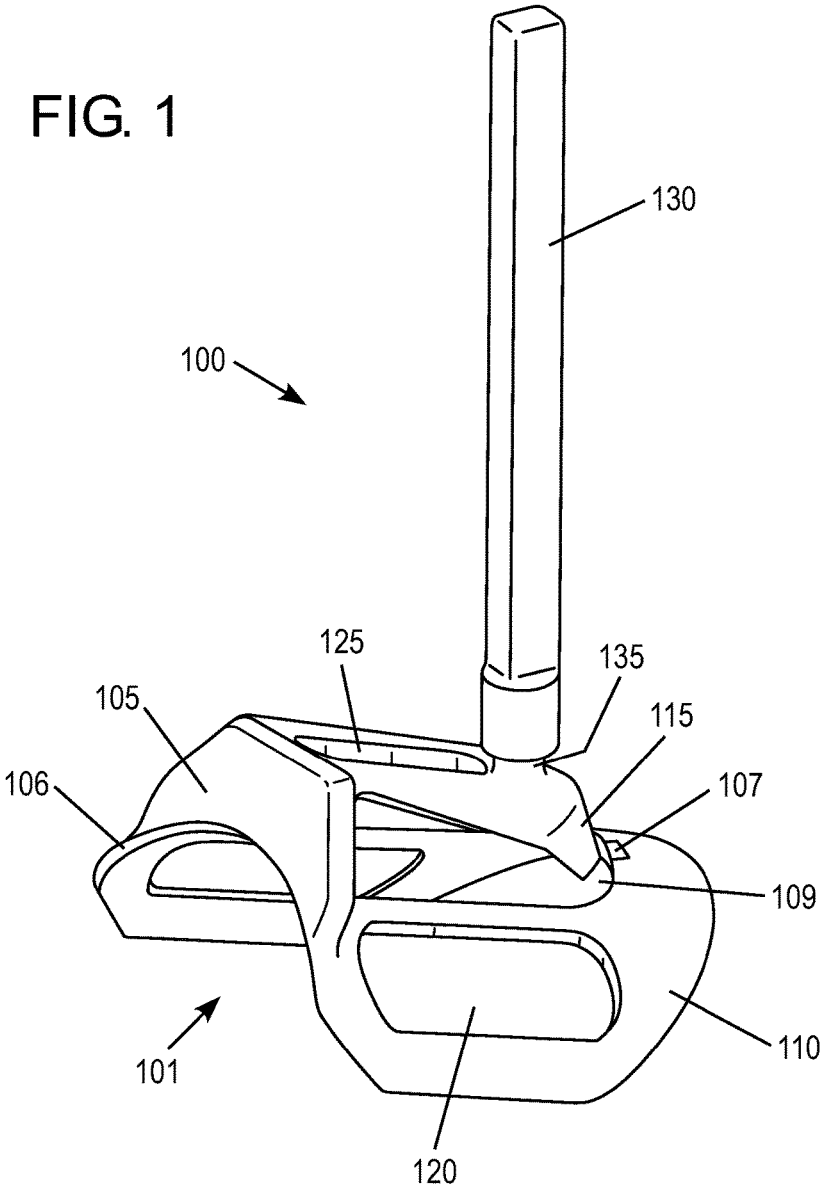
FIG. 1 illustrates an embodiment of an attachable golfing aid according to an embodiment as disclosed herein.

In the following detailed description, numerous specific embodiments are set forth in order to provide a thorough understanding of the attachable golfing aid and methods disclosed herein. However, as will be apparent to those skilled in the art, the present embodiments may be practiced without these specific details or by using alternate elements or processes. In other instances, well-known processes, procedures, and/or components have not been described in detail so as not to unnecessarily obscure aspects of embodiments disclosed herein. As used herein, the terms "swing" and "stroke" may refer to a putting stroke, a partial swing, chipping stroke, or a full swing. As used herein, the terms "outward" and "outwardly" are in relation to a direction parallel or generally parallel to the shoulder plane of a golfer, and the terms "upward" and "upwardly" are in relation to a direction perpendicular or generally perpendicular to the shoulder plane of a golfer. As used herein, "reference path" may refer to a swing path, a swing plane, and/or a swing alignment. Like numerals in FIGS. 1-7 refer to like elements of present embodiments as disclosed herein.

As indicated, present embodiments provide an attachable golfing aid ("golfing aid") that is operable to train a golfer to have a better posture, alignment, and proper shoulder movement (which also trains proper lower body movement) before, during, and/or after a golf stroke. Further, the attachable golfing aid indicates and prevents over-swinging, and improves speed and accuracy during a swing of a golfer. Furthermore, the aid reduces body stress a golfer may endure during a swing.

The attachable golfing aid includes an attachable component that is attachable to a body of the golfer or a shirt of the golfer. The attachable component can attach to the body of the golfer or the shoulder of a golfer such that a portion of the attachable component fits against the shoulder of a golfer. The attachable golfing aid includes one or more visual indicators which provide a reference to the golfer and aid in training proper posture, alignment, shoulder movement, and lower body movement. The attachable golfing aid preferably also indicates when a golfer is over-swinging. For example, the attachable golfing aid can include a visual indicator (i.e. an upwardly or outwardly extending visual aid) to provide a visual reference for the golfer. Additionally, the visual indicator or another portion of the attachable golfing aid can contact a portion of the golfer's body to alert the golfer when his or her swing is improper. For example, the visual indicator can contact a golfer's head when a golfer starts the swing with poor torso motion which generally leads to an over swinging motion.

A golfer can wear the attachable golfing aid on their dominant shoulder, their non-dominant shoulder, or an individual attachable golfing aid on each the dominant and non-dominant shoulders. Wearing the golfing aid on the dominant shoulder can help train certain swing elements that are different from swing elements that may be trained when a golfer wears the golfing aid on the non-dominant shoulder. The golfing aid can also help a golfer identify their shoulder location, hip location, and knee location and help a golfer improve their swing path, alignment, shoulder plane, weight transfer, stance, ball position, and hand path during the swing.

The attachable golfing aid can include a removable or non-removable outwardly extending visual aid that extends outwardly from the shoulder of the golfer when the attachable component is attached to the body of the golfer or the shirt of the golfer. The outwardly extending visual aid is configured to indicate an alignment and/or position of the golfer's shoulder before, during, and/or after a swing of the golfer. In an embodiment wherein the golfer wears an attachable golfing aid on each shoulder, each golfing aid preferably includes respective outwardly extending visual aids wherein the outwardly extending visual aids can form a straight or substantially straight line when a golfer is readying for their swing.

The attachable golfing aid can include a removable or non-removable upwardly extending visual aid that extends upwardly from the shoulder of the golfer when the attachable component is attached to the body of the golfer or the shirt of the golfer. The upwardly extending visual aid is configured to indicate an alignment and/or position of the golfer's shoulder before, during, and/or after a swing of the golfer. The attachable golfing aid preferably includes the upwardly extending visual aid when the golfer wears the golfing aid on their dominant shoulder. If a golfer over-swings in their back stroke, the upwardly extending visual aid is preferably positioned such that the golfer's head will contact the upwardly extending visual aid, which thereby does not allow a golfer to over-swing.

Figure 2:
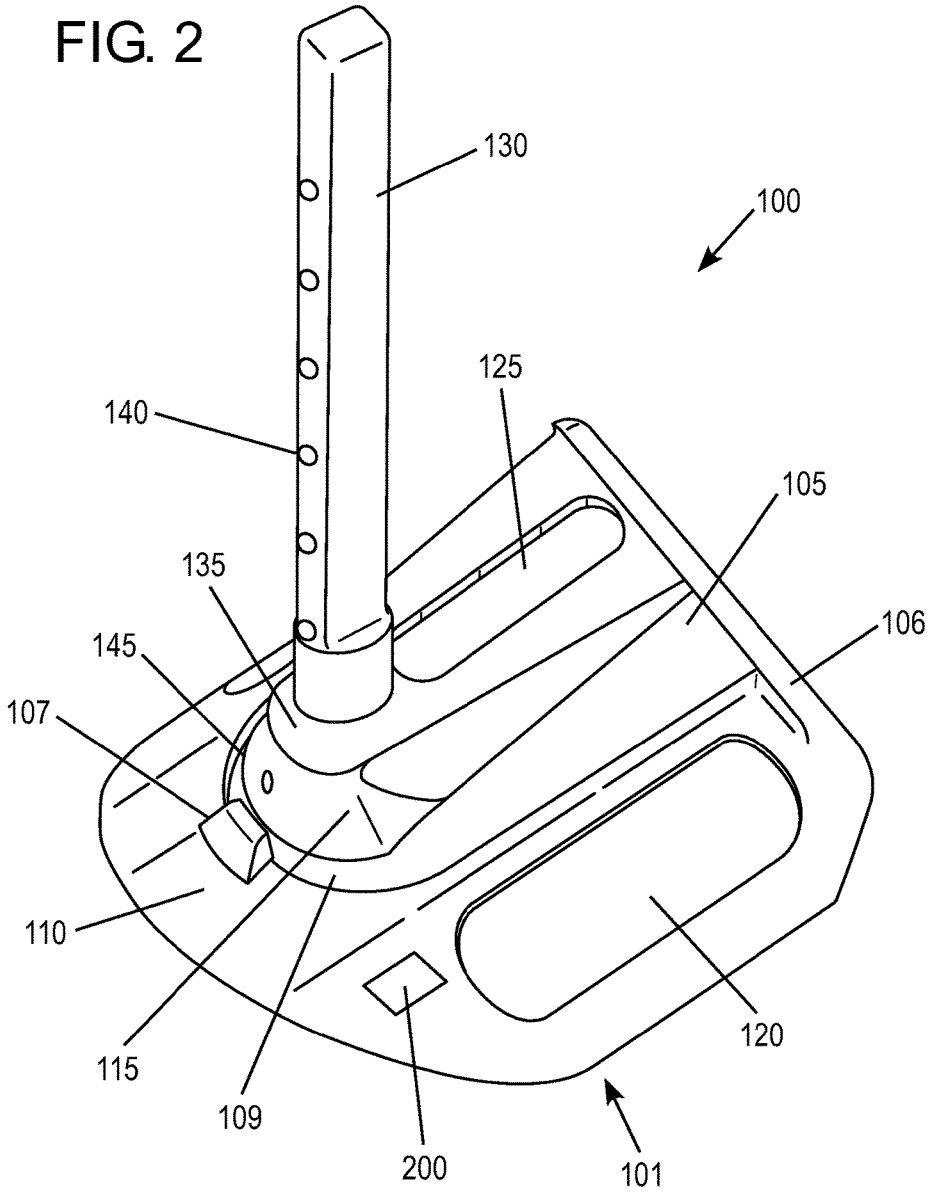
FIG. 2 illustrates an embodiment of an attachable golfing aid according to an embodiment as disclosed herein.

FIGS. 1-2 illustrate an embodiment of an attachable golfing aid 100 according to an embodiment as disclosed herein. As shown in FIGS. 1 and 2, the attachable golfing aid 100 includes an attachable component 101 that is attachable to a shirt of the golfer. The attachable component 101 is preferably a contoured plate 105 that is contoured to fit on a shoulder of a golfer when the attachable component 101 is attached to the golfer. The contoured plate 105 can include a lower plate 110 and an upper plate 115 wherein the lower plate 110 and upper plate 115 form a slit 109 therebetween. The collar of a golfer's shirt can be slid into the slit 109 such that the slit 109 receives a portion of a golfer's shirt. The attachable golfing aid 100 is held in place by a clamping or frictional force exerted by the upper and lower plates 115, 110. In an embodiment, the upper and lower plates 115, 110 are connected at an end thereof by a resilient portion 106 of the contoured plate 105 that extends between the upper and lower plates 115, 100 and biases the opposite ends of the upper and lower plates 115, 110 towards each other. In this manner, the contoured plate 105 may be attached to the shirt of the golfer wherein the lower plate 110 is configured to fit on the shoulder of the golfer. In an alternate embodiment, the upper and lower plates 115, 110 can be connected at an end thereof by a hinge wherein the plates 115, 110 can be locked in place. The contoured plate 105 may be contoured to attach to either a right shoulder or left shoulder of a golfer. In a further embodiment, the upper and lower plates 115, 110 can each include magnets such that a magnetic force can hold the upper and lower plates 115, 110 together on either side of the golfer's shirt. In this embodiment, the upper and lower plates 115, 110 can be completely separate, or alternatively, the upper and lower plates 115, 110 can be connected on one end thereof.

In an embodiment, the upper plate 115 of the contoured plate 105 can include one or more cut outs 125 which each extend between an upper and lower surface thereof. The one or more cutouts 125 of the upper plate 115 can increase the flexibility of the upper plate 115 of the contoured plate 105 such that the attachable golfing aid 100 has increased flexibility. In an embodiment, the lower plate 110 of the contoured plate 105 can include one or more cut outs 120, which each extend between an upper and lower surface thereof. The one or more cutouts 120 can increase the flexibility of the lower plate 110 of the contoured plate 105 such that the attachable golfing aid 100 has increased flexibility. In an embodiment, the contoured plate 105 can include a pad 161 (see FIGS. 3, 5, and 6) on the lower surface thereof, wherein the pad is configured to provide a cushion between the lower plate and a golfer's shoulder. In an embodiment, the pad may be included on the lower surface of the lower plate 110. In a further embodiment, the pad can be included on the lower surface of the upper plate 115, wherein the pad increases the coefficient of friction between a golfer's shirt and the attachable golf aid 100.

In an embodiment, the lower plate 110 can include one or more upwardly extending tabs 107 on an upper surface thereof. The one or more upwardly extending tabs 107 are operable to reduce the volume of the slit 109 between the upper and lower plates 115, 110, and therefore increase the frictional fit of a golfer's shirt in the slit 109, or increase the clamping force applied to the golfer's shirt. In an embodiment, the upper plate 115 can include one or more downwardly extending tabs (not shown) on a lower surface thereof. The one or more downwardly extending tabs are also operable to reduce the volume of the slit 109 between the upper and lower plates 115, 110 so as to increase the frictional fit of a golfer's shirt in the slit 109, or increase the clamping force applied to the golfer's shirt. In a further embodiment, the upwardly or downwardly extending tabs may be configured to overlap at an entrance portion of the slit 109 so as to aid in gripping a shirt of the golfer.

The attachable golfing aid 100 can include an upwardly extending visual aid 130 that extends upwardly from the shoulder of the golfer when the attachable golfing aid is attached to the body of the golfer or the shirt of the golfer. During use, the upwardly extending visual aid 130 is configured to indicate an alignment and/or position of the golfer's shoulder before, during, and/or after a swing of the golfer. In an embodiment, the upwardly extending visual aid 130 can be removable from the attachable component 101. In an alternate embodiment, the upwardly extending visual aid 130 is not removable from the attachable component 101. In an embodiment, the upwardly extending visual aid 130 may be operable to telescope towards and away from the attachable component 101.

FIGS. 1 and 2 illustrate an attachable golfing aid 100 wherein the upwardly extending visual aid 130 is removable from the attachable component 101. In this embodiment, the upper plate 115 of the contoured plate 105 includes a connection element 135 that is operable to attach the removable upwardly extending visual aid 130. In an embodiment, the connection element 135 can be formed by any suitable means such as a plug and socket connection wherein a plug of the attachable component 101 may be plugged into a socket of the upwardly extending visual aid 130, or vice versa. In an alternate embodiment, the connection element 135 can include screw threads wherein the upwardly extending visual aid 130 includes a threaded opening that is screwed onto threads of the connection element, or vice versa. By making the upwardly extending visual aid 130 removable, upwardly extending visual aids 130 having different heights and/or cross sections can be attached to the attachable component 101. This allows a golfer to customize the upwardly extending visual aid 130 to their individual height, as well as allows a golfer to swap upwardly extending visual aids 130 having varying markings or shapes, which may provide different visual references to the golfer or visual references which are at the proper height for an individual golfer. Providing a removable upwardly extending visual aid 130 also allows a golfer to disassemble the attachable golfing aid 100 for more convenient storage when not in use.

Figure 3:
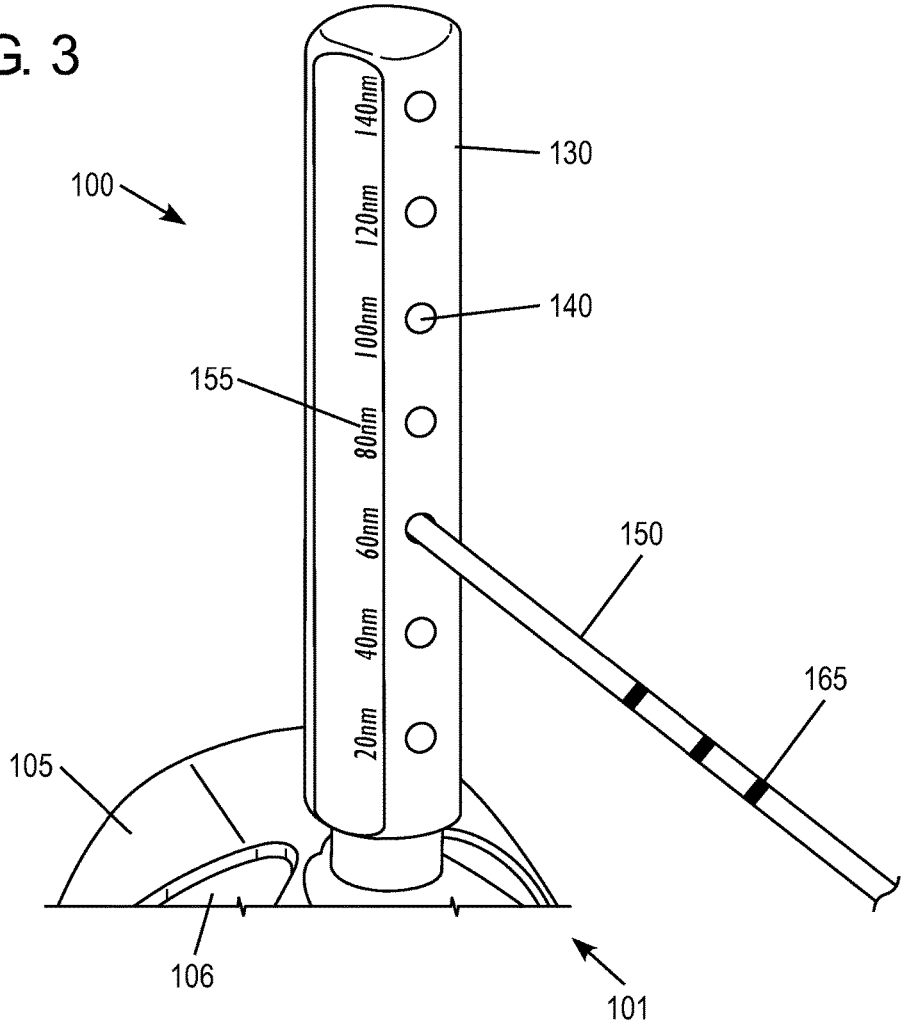
FIG. 3 illustrates an embodiment of an attachable golfing aid according to an embodiment as disclosed herein.
Figure 4:
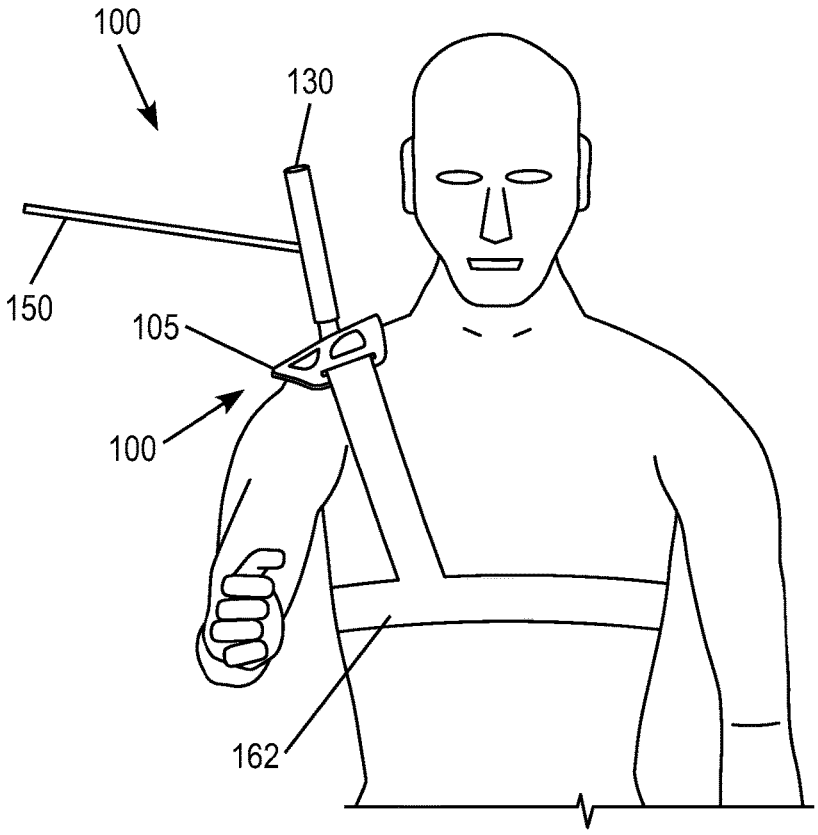
FIG. 4 illustrates an embodiment of an attachable golfing aid according to an embodiment as disclosed herein.

As shown in FIG. 3, the attachable golfing aid 100 can include an outwardly extending visual aid 150 that extends outwardly from the shoulder of the golfer when the attachable component 101 is attached to the body of the golfer or the shirt of the golfer. The outwardly extending visual aid 150 preferably extends outwardly parallel to the direction of a golfer's shoulder when the attachable golfing aid is attached to the body or shirt of a golfer. The outwardly extending visual aid 150 is configured to indicate an alignment and/or position of the golfer's shoulder before, during, and/or after a swing of the golfer. In an embodiment, the vertical height of the outwardly extending visual aid 150 may be adjusted along the length of the upwardly extending visual aid 130. For example, in the embodiments shown in FIGS. 2 and 3, the upwardly extending visual aid 130 includes connection elements 140 along the length thereof such that the outwardly extending visual aid 150 may be connected at various heights along the length of the upwardly extending visual aid 130. In an embodiment, as shown in FIG. 2, the upper plate 115 of the contoured plate 105 can also include a connection element 145 such that the removable outwardly extending visual aid 150 can be connected directly to the attachable component 101 rather than the upwardly extending visual aid 130. In this embodiment, the upwardly extending visual aid 130 need not be attached to the attachable component 101. Golfers may prefer this embodiment when the attachable golfing aid 100 is used on the golfer's non-dominant shoulder.

The connection elements 140 and 145 may be plug and socket connection elements or screw thread connection elements. For example, a plug of the attachable component 101 or the upwardly extending visual aid 130 may be plugged into a socket of the outwardly extending visual aid 150, or vice versa. In an alternate embodiment, the a threaded opening of the attachable component 101 or the upwardly extending visual aid 130 may be threaded onto a screw thread at an end of the outwardly extending visual aid 150, or vice versa, to complete the connection. In an embodiment, the connection elements 140 may be configured such that the outwardly extending visual aid 150 extends outwardly from the upwardly extending visual aid 130 component horizontally, at an upward angle, or at a downward angle. In an embodiment, the connection elements 140 may also be configured such that the outwardly extending visual aid 150 has a forward tilt or backward tilt with respect to the shoulder plane of a golfer. In an embodiment, the connection element 145 may be configured such that the outwardly extending visual aid 150 extends outwardly from the attachable component 101 horizontally, at an upward angle, or at a downward angle. In an embodiment, the connection element 145 may also be configured such that the outwardly extending visual aid 150 has a forward tilt or backward tilt with respect to the shoulder plane of a golfer. In an embodiment, the outwardly extending visual aid 150 is operable to telescope inwardly and outwardly such that the distance between an outer end of the outwardly extending visual aid 150 and the attachable component 101 or the upwardly extending visual aid 130 may be adjusted. In a further embodiment, as shown in FIG. 3, the outwardly extending visual aid 150 includes one or more markings 165 configured to provide a visual reference to a golfer when the attachable component 101 is attached to the body of the golfer or shirt of the golfer.

In an embodiment, the upwardly extending visual aid 130 can be rod shaped and have any suitable cross section, such as a circular, rectangular, hexagonal, or octagonal cross section. In an embodiment different faces of the upwardly extending visual aid 130 can include different connection elements 140 such that the outwardly extending visual aid 150 can be set at different angles and/or tilts such as an upward angle, horizontal angle, or downward angle and/or parallel to should plane, forward tilt (i.e. forwardly outwardly), or backward tilt (i.e. rearwardly outwardly). Markings 155 can be provided to indicate to a golfer which setting the connection element 140 corresponds to when the outwardly extending visual aid 150 is attached thereto. In an alternate embodiment, the upwardly extending visual aid 130 can be cone shaped (see FIG. 7).

FIGS. 4-7 illustrate an alternate embodiment of an attachable component 101. In this embodiment, the attachable component 101 is a contoured plate 105 wherein the contoured plate 105 includes openings 160. The openings can include straps 162 (see FIG. 4) therein that are operable to attach the attachable golfing aid 100 to the body of a golfer. The straps 162 can be any type of straps operable to connect the attachable golfing aid to the body of a golfer such as straps that are tie-able straps, the straps are elastic straps, the straps include buckles, the straps include a tightening device, or the straps are velcro straps. In this embodiment, the contoured plate 105 does not include the upper and lower plates.

Figures 5, 6:
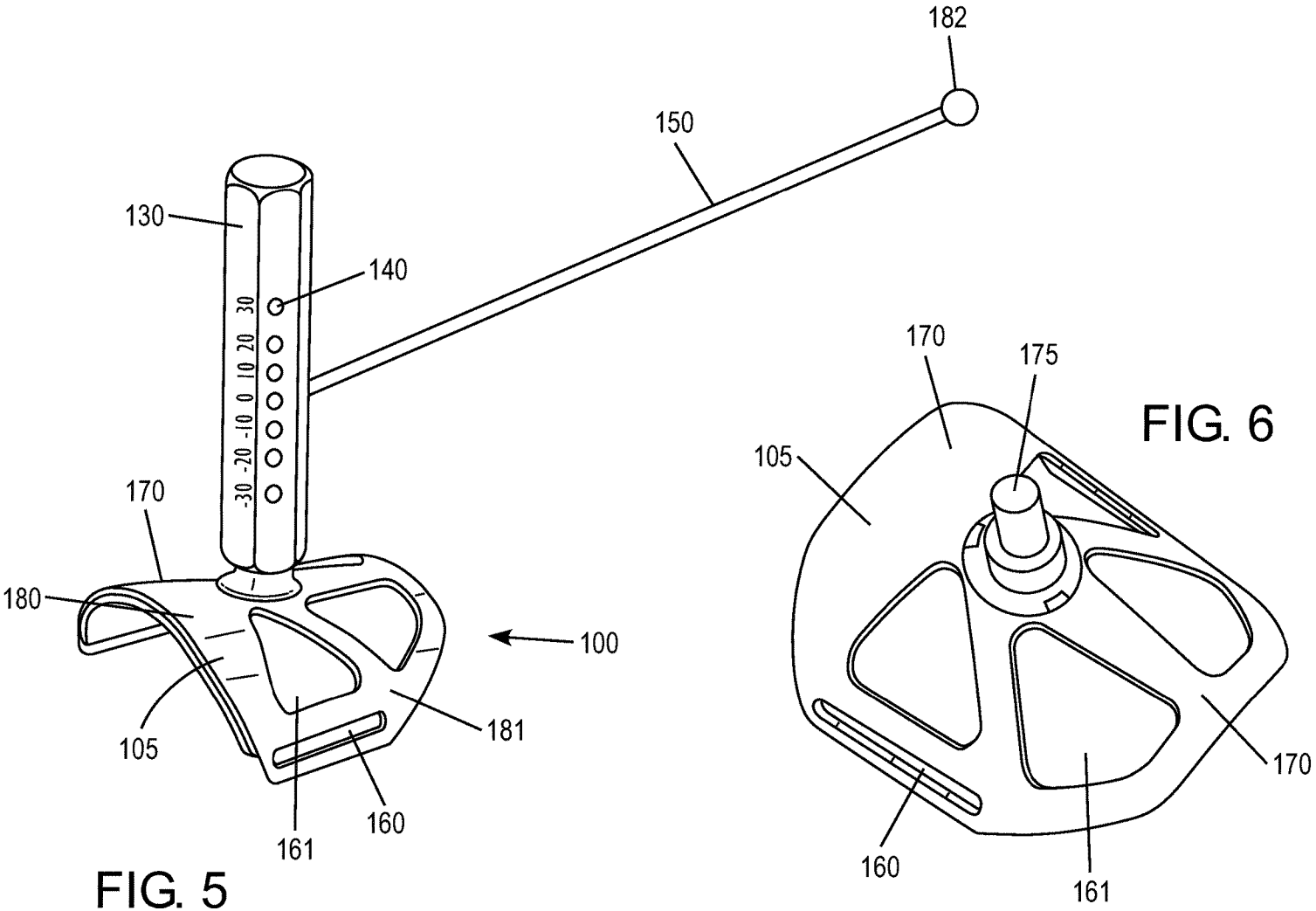
FIG. 5 illustrates an embodiment of an attachable golfing aid according to an embodiment as disclosed herein.
FIG. 6 illustrates an embodiment of an attachable golfing aid according to an embodiment as disclosed herein.
Figure 7:
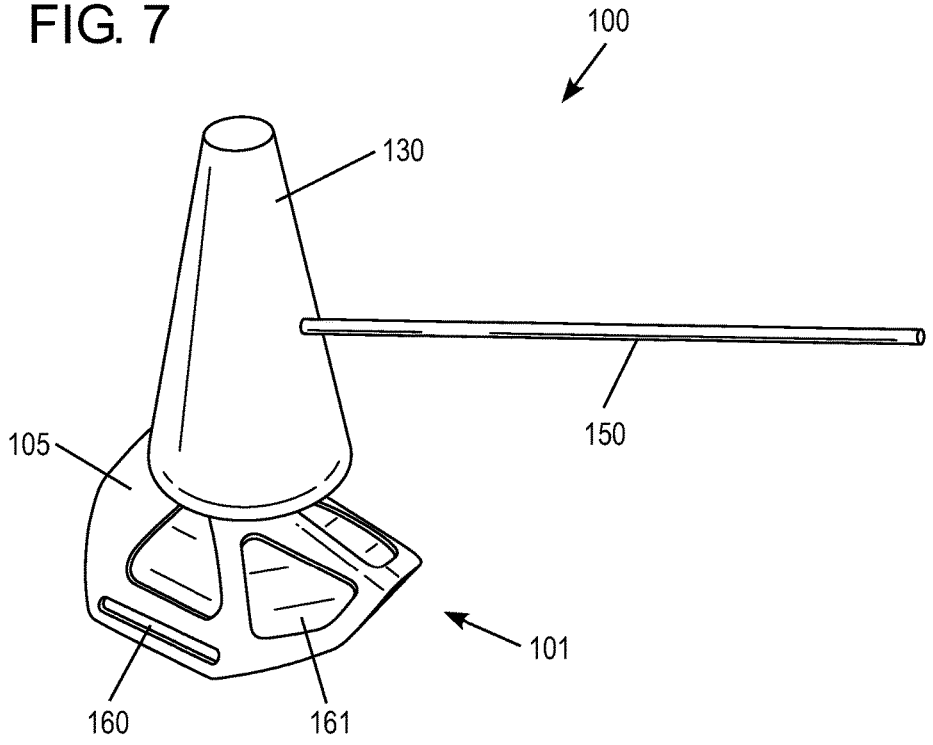
FIG. 7 illustrates an embodiment of an attachable golfing aid according to an embodiment as disclosed herein.

Referring now to FIGS. 5 and 6, the attachable component 201 can include a region 170 for a logo to be printed thereupon. In an embodiment (see FIGS. 3 and 5), the upwardly extending visual aid 130 includes one or more markings 155 which provide a visual reference to a golfer when the attachable component is attached to the body of the golfer or shirt of the golfer. In an embodiment, the markings 155 can indicate to a golfer the angle (i.e., horizontal, upward, or downward angle) at which the outwardly extending visual aid 150 will extend from the upwardly extending visual aid 150.

In an embodiment, the attachable golfing aid 100 can include one or more lasers 180, a level 181, and/or one or more lights 182 (see FIG. 5) that can provide a reference for a golfer. For example, a light 182 at the end of the outwardly extending visual aid 150 is viewable in a golfer's peripheral vision and can leave a light path during the swing of the golfer. In an embodiment, the level 181, lights 182, and/or the laser 180, as well as other electronic functions of the golfing aid 100, can communicate with a golfer's cell phone via a cell phone application and blue tooth or the like. In this embodiment, the golf aid 100 includes necessary electrical components such as a logic controller, rechargeable power source, radio transmitter, memory, and the like. For example, as shown in FIG. 2, the attachable golfing aid 100 includes electrical components 200 that can communicate with a cell phone via blue tooth or other wireless technology such that the torso movement and/or shoulder movement of a golfer can be analyzed. Preferably the electrical components 200 can be configured such that at least one of swing speed, carry distance, launch angle, and/or spin rate can be analyzed. For example, in an embodiment, the electrical components 200 can include a three axis accelerometer operable to transmit acceleration data to a programmed logic controller, and an optional three axis gyroscope operable to transmit angular velocity data to the logic controller. The logic controller can transmit the data, processed or unprocessed, to a cell phone or computer wherein a golfer may thereby receive swing feedback via a computer program or cell phone application. In a further embodiment, the electrical components 200 can include a three axis magnetometer operable to transmit directional orientation data to the logic controller. In an embodiment, the outwardly extending visual aid can extend outwardly about four inches or more beyond the outer periphery of from the attachable component 101, and the upwardly extending visual aid 130 can extend upwardly about three inches or more from the attachable component 101.

Further disclosed herein are methods of using the attachable golfing aid 100. Preferably, a golfer attaches a first attachable golfing aid (dominant golfing aid) including an upwardly extending visual aid 130 and an outwardly extending visual aid 150 on his or her dominant shoulder and a second attachable golfing aid (non-dominant golfing aid) including an outwardly extending visual aid 150 on his or her non-dominant shoulder. When standing upright, the upwardly extending visual aid 130 of the dominant golfing aid preferably bisects the golfer's ear. At address (i.e. when a golfer is readied to swing) the tilt of the golfer's head and the upwardly extending visual aid 130 are preferably parallel.

The outwardly extending visual aids 150 of the dominant golfing aid and the non-dominant golfing aid work in conjunction. Preferably, when a golfer has proper form, both of the outwardly extending visual aids 150 are parallel to the golfer's target line. If the dominant outwardly extending visual aid 150 crosses the target line, then the golfer is alerted that his or her shoulders are open relative to the target line. Likewise, if the non-dominant outwardly extending visual aid 150 is pulled back from the target line, then the golfer is alerted that his or her shoulders are closed relative to the target line. Conversely, if the dominant outwardly extending visual aid 150 is pulled back from the target line, then the golfer is alerted that his or her shoulders are closed relative to the target line. Likewise, if the non-dominant outwardly extending visual aid 150 crosses the target line, then the golfer is alerted that his or her shoulders are closed relative to the target line.

During a proper swing, the upwardly extending visual aid 130 will disappear behind the golfer's head and not contact the golfer's head. If the golfer has a poor swing, such as an over-swing, or the golfer is putting unneeded stress on their body, the upwardly extending visual aid 130 will preferably contact the head of the golfer during the first half of the backswing.

If a proper torso motion is performed by a golfer, the dominant outwardly extending visual aid 150 will be in the following positions: (1) at address: the dominant outwardly extending visual aid 150 will be on a downward slant because the back hand of the golfer is lower than the front hand on the grip; (2) at position 1: the dominant outwardly extending visual aid 150 will be level to the ground; (3) at position 2: the dominant outwardly extending visual aid 150 will be slanted up towards the sky; (4) at position 3: the dominant outwardly extending visual aid 150 will be approximately parallel to the ground and approximately parallel to the club shaft; (5) at position 4: the dominant outwardly extending visual aid 150 will be a slight downward tilt, similar to the address position; (6) at position 5: the dominant outwardly extending visual aid 150 will be parallel to the ground and perpendicular to the target line; (7) at position 6: the dominant outwardly extending visual aid 150 will be parallel to the ground and approximately perpendicular to the target line.

Further, if a proper torso motion is performed by a golfer, the non-dominant outwardly extending visual aid 150 will be in the following positions: (1) at address: the non-dominant outwardly extending visual aid 150 will be on an upward slant because the front hand is higher on the grip than the left hand; (2) at position 1: the non-dominant outwardly extending visual aid 150 will be level to the ground; (3) at position 2: the non-dominant outwardly extending visual aid 150 will be slanted down towards the ground; (4) at position 3: the non-dominant outwardly extending visual aid 150 will be approximately parallel to the ground or possibly on a small downward slant; (5) at position 4: the non-dominant outwardly extending visual aid 150 will be a slight tilt upward or basically parallel to the ground; (6) at position 5: the non-dominant outwardly extending visual aid 150 will be parallel to the ground and perpendicular to the target line; (7) at position 6: the non-dominant outwardly extending visual aid 150 will be parallel to the ground and approximately perpendicular to the target line.

Further, the dominant outwardly extending visual aid 130 will prevent over-swinging by a golfer because if a golfer over-swings the dominant outwardly extending visual aid 130 will contact the golf club.

While the attachable golfing aid has been described in detail with reference to specific embodiments thereof, it will be apparent to those skilled in the art that various changes and modifications can be made, and equivalents employed, without departing from the scope of the appended claims.

What is claimed is:

1. An attachable golfing aid operable to provide a reference for a golfer during a swing, the attachable golfing aid comprising:

an attachable component that is attachable to a body of the golfer or a shirt of the golfer; and an outwardly extending visual aid that extends outwardly from the shoulder of the golfer when the attachable component is attached to the body of the golfer or the shirt of the golfer, the outwardly extending visual aid configured to indicate an alignment and/or position of the golfer's shoulder before, during, and/or after a swing of the golfer;

wherein the outwardly extending visual aid is operable to telescope inwardly and outwardly such that the distance between an outer end of the outwardly extending visual aid and the attachable component may be adjusted.

2. The attachable golfing aid of claim 1, wherein the attachable component is a contoured plate configured to fit on a shoulder of the golfer when the attachable component is attached to the golfer, the contoured plate including a lower plate and an upper plate wherein the lower plate and upper plate form a slit that is configured to receive a portion of a golfer's shirt such that the contoured plate may be attached to the shirt of the golfer wherein the lower plate is configured to fit on the shoulder of a golfer when the contoured plate is attached to the shirt of the golfer.

3. The attachable golfing aid of claim 2, wherein (a) the lower plate is resiliently connected to the upper plate;

(b) the contoured plate includes a region for a logo to be printed;

(c) the contoured plate is contoured for a right shoulder or a left shoulder of a golfer;

(d) the upper plate includes one or more cut outs each extending between an upper and lower surface thereof, wherein the one or more cutouts are configured to increase the flexibility of the contoured plate;

(e) the lower plate includes one or more cut outs each extending between an upper and lower surface thereof, wherein the one or more cutouts are configured to increase the flexibility of the contoured plate;

(f) the lower plate includes a pad on a lower surface thereof, the pad configured to provide a cushion between the lower plate and a golfer's shoulder;

(g) the outwardly extending visual aid extends outwardly from the upper plate;

(h) the upper plate includes a connection element configured to connect the outwardly extending visual aid to the upper plate such that the outwardly extending visual aid is removable from the upper plate;

(i) the lower plate is connected to the upper plate by a hinge wherein the hinge is operable to lock the upper and lower plates in a clamped position;

(j) the lower plate and the upper plate each include magnets wherein the upper plate is configured to be magnetically attracted to the lower plate such that the lower plate and upper plate can be clamped on the shirt of a golfer;

(k) the lower plate includes an upwardly extending tab on an upper surface thereof, the upwardly extending tab operable to reduce the volume of the slit between the upper and lower plates; and/or (l) the upper plate includes a downwardly extending tab on a lower surface thereof, the downwardly extending tab operable to reduce the volume of the slit between the upper and lower plates.

4. The attachable golfing aid of claim 1, wherein:

(a) the outwardly extending visual aid is removable from the attachable component;

(b) the outwardly extending visual aid extends outwardly from the attachable component horizontally, at an upward angle, or at a downward angle;

(c) the outwardly extending visual aid extends forwardly outwardly or rearwardly outwardly;

(d) the outwardly extending visual aid includes one or more markings configured to provide a visual reference to a golfer when the attachable component is attached to the body of the golfer or shirt of the golfer; and/or (e) the outwardly extending visual aid extends outwardly parallel to the direction of a golfer's shoulder when the attachable golfing aid is attached to the body or shirt of a golfer.

5. The attachable golfing aid of claim 1, wherein the attachable component includes a connection element, the connection element operable to attach a removable upwardly extending visual aid thereto.

6. The attachable golfing aid of claim 5, further comprising an upwardly extending visual aid connected to the connection element of the attachable component, the upwardly extending visual aid extending upwardly from the shoulder of the golfer when the attachable component is attached to the body of the golfer or the shirt of the golfer wherein the upwardly extending visual aid is configured to indicate an alignment and/or position of the golfer's shoulder before, during, and/or after a swing of the golfer.

7. The attachable golfing aid of claim 6, wherein;

(a) the upwardly extending visual aid is rod shaped;

(b) the upwardly extending visual aid is cone shaped;

(c) the upwardly extending visual aid includes one or more markings configured to provide a visual reference to a golfer when the attachable component is attached to the body of the golfer or shirt of the golfer;

(d) the upwardly extending visual aid includes one or more connection elements, each connection element configured to connect an outwardly extending visual aid to the upwardly extending visual aid such that the outwardly extending visual aid is detachable from the upwardly extending visual aid;

(e) the outwardly extending visual aid extends outwardly from the upwardly extending visual aid wherein the vertical height of the outwardly extending visual aid may be adjusted along the length of the upwardly extending visual aid;

(f) the outwardly extending visual aid extends outwardly from the upwardly extending visual aid;

(g) the outwardly extending visual aid extends outwardly from the upwardly extending visual aid wherein the vertical height of the outwardly extending visual aid may be adjusted along the length of the upwardly extending visual aid;

(h) the upwardly extending visual aid is operable to telescope towards and away from the attachable component;

(i) the outwardly extending visual aid extends outwardly from the upwardly extending visual aid horizontally, at an upward angle, or at a downward angle; or (j) the outwardly extending visual aid extends forwardly outwardly or rearwardly outwardly.

8. The attachable golfing aid of claim 1, wherein the attachable component is a contoured plate, the contoured plate including openings that include straps therein that are operable to attach the attachable golfing aid to the body of a golfer, wherein the straps are tie-able straps, the straps are elastic straps, the straps include buckles, the straps include a tightening device, or the straps are velcro straps.

9. An attachable golfing aid operable to provide a reference for a golfer during a swing, the attachable golfing aid comprising:

an attachable component that is attachable to a body of the golfer or a shirt of the golfer; and an upwardly extending visual aid that extends upwardly from the shoulder of the golfer when the attachable component is attached to the body of the golfer or the shirt of the golfer wherein the upwardly extending visual aid is configured to indicate an alignment and/or position of the golfer's shoulder before, during, and/or after a swing of the golfer;

wherein the attachable component is a contoured plate configured to fit on a shoulder of the golfer when the attachable component is attached to the golfer, the contoured plate including a lower plate and an upper plate which form a slit that is configured to receive a portion of a golfer's shirt such that the contoured plate may be attached to the shirt of the golfer, the lower plate is configured to fit on the shoulder of a golfer when the contoured plate is attached to the shirt of the golfer, the lower plate including a pad on a lower surface thereof that is configured to provide a cushion between the lower plate and a golfer's shoulder.

10. The attachable golfing aid of claim 9, wherein (a) the lower plate is resiliently connected to the upper plate;

(b) the contoured plate includes a region for a logo to be printed;

(c) the contoured plate is contoured for a right shoulder or a left shoulder of a golfer;

(d) the upper plate includes one or more cut outs each extending between an upper and lower surface thereof, wherein the one or more cutouts are configured to increase the flexibility of the contoured plate;

(e) the lower plate includes one or more cut outs each extending between an upper and lower surfaces thereof, wherein the one or more cutouts are configured to increase the flexibility of the contoured plate;

(f) a removable outwardly extending visual aid extends outwardly from the upper plate;

(g) the upper plate includes a connection element configured to connect a removable outwardly extending visual aid to the upper plate;

(h) the lower plate is connected to the upper plate by a hinge wherein the hinge is operable to lock the upper and lower plates in a clamped position;

(i) the lower plate and the upper plate each include magnets wherein the upper plate is configured to be magnetically attracted to the lower plate such that the lower plate and upper plate can be clamped on the shirt of a golfer;

(j) the lower plate includes an upwardly extending tab on an upper surface thereof, the upwardly extending tab operable to reduce the volume of the slit between the upper and lower plates; and/or (k) the upper plate includes a downwardly extending tab on a lower surface thereof, the downwardly extending tab operable to reduce the volume of the slit between the upper and lower plates.

11. The attachable golfing aid of claim 9, wherein the attachable golfing aid further includes a removable outwardly extending visual aid that extends outwardly from the shoulder of the golfer when the attachable component is attached to the body of the golfer or the shirt of the golfer wherein the outwardly extending visual aid is configured to indicate an alignment and/or position of the golfer's shoulder before, during, and/or after a swing of the golfer.

12. The attachable golfing aid of claim 11, wherein (a) the outwardly extending visual aid is a operable to telescope inwardly and outwardly such that the distance between an outer end of the outwardly extending visual aid and the attachable component may be adjusted;

(b) the attachable component includes a connection element such that the removable outwardly extending visual aid may be connected to the attachable component;

(c) the outwardly extending visual aid extends outwardly from the attachable component horizontally, at an upward angle, or at a downward angle;

(d) the outwardly extending visual aid extends forwardly outwardly or rearwardly outwardly;

(e) the outwardly extending visual aid includes one or more markings configured to provide a visual reference to a golfer when the attachable component is attached to the body of the golfer or shirt of the golfer; and/or (f) the outwardly extending visual aid extends outwardly parallel to the direction of a golfer's shoulder when the attachable golfing aid is attached to the body or shirt of a golfer.

13. The attachable golfing aid of claim 9, wherein the attachable component includes a connection element, the connection element operable to attach to the upwardly extending visual aid such that the upwardly extending visual aid may be removed from the attachable component.

14. The attachable golfing aid of claim 9, wherein;

(a) the upwardly extending visual aid is rod shaped;

(b) the upwardly extending visual aid is cone shaped;

(c) the upwardly extending visual aid includes one or more markings configured to provide a visual reference to a golfer when the attachable component is attached to the body of the golfer or shirt of the golfer;

(d) the upwardly extending visual aid includes one or more connection elements, each connection element configured to connect to an outwardly extending visual aid such that the outwardly extending visual aid is detachable from the upwardly extending visual aid;

(e) an outwardly extending visual aid extends outwardly from the upwardly extending visual aid wherein the outwardly extending visual aid is operable to telescope inwardly and outwardly such that the distance between an outer end of the outwardly extending visual aid and the upwardly extending visual aid may be adjusted;

(f) an outwardly extending visual aid extends outwardly from the upwardly extending visual aid wherein the vertical height of the outwardly extending visual aid may be adjusted along the length of the upwardly extending visual aid;

(g) the upwardly extending visual aid is operable to telescope towards and away from the attachable component;

(h) an outwardly extending visual aid extends outwardly from the upwardly extending visual aid horizontally, at an upward angle, or at a downward angle; or (i) the outwardly extending visual aid extends forwardly outwardly or rearwardly outwardly.

15. The attachable golfing aid of claim 9, wherein the contoured plate includes openings that include straps therein that are operable to attach the attachable golfing aid to the body of a golfer, wherein the straps are tie-able straps, the straps are elastic straps, the straps include buckles, the straps include a tightening device, or the straps are velcro straps.

16. An attachable golfing aid operable to provide a reference for a golfer during a swing, the attachable golfing aid comprising:

a contoured plate that is attachable to a body of the golfer or a shirt of the golfer, the contoured plate including a first connection element configured to connect to an optional removable outwardly extending visual aid and a second connection element configured to connect to an optional removable upwardly extending visual aid;

wherein the contoured plate is configured to fit on a shoulder of a golfer when the attachable golfing aid is attached to the body or shirt of the golfer, the contoured plate including a pad on a lower surface thereof that is configured to provide a cushion between the lower plate and a golfer's shoulder.

17. The attachable golfing aid of claim 16, further comprising a removable outwardly extending visual aid connected to the first connection element wherein the removable outwardly extending visual aid extends outwardly from the shoulder of the golfer when the contoured plate is attached to the body of the golfer or the shirt of the golfer wherein the outwardly extending visual aid is configured to indicate an alignment and/or position of the golfer's shoulder before, during, and/or after a swing of the golfer.

18. The attachable golfing aid of claim 16, further comprising a removable upwardly extending visual aid connected to the second connection element wherein the removable upwardly extending visual aid extends upwardly from the shoulder of the golfer when the contoured plate is attached to the body of the golfer or the shirt of the golfer wherein the upwardly extending visual aid is configured to indicate an alignment and/or position of the golfer's shoulder before, during, and/or after a swing of the golfer.

19. The attachable golfing aid of claim 16, wherein:

(a) the contoured plate includes a lower plate and an upper plate wherein the lower plate and upper plate form a slit that is configured to receive a portion of a golfer's shirt such that the contoured plate may be attached to the shirt of the golfer wherein the pad is on a lower surface of the lower plate; or (b) the contoured plate includes openings that include straps therein that are operable to attach the attachable golfing aid to the body of a golfer, wherein the straps are tie-able straps, the straps are elastic straps, the straps include buckles, the straps include a tightening device, or the straps are velcro straps.

* * * * *